US009689322B2

(12) United States Patent
Xiao et al.

(10) Patent No.: US 9,689,322 B2
(45) Date of Patent: Jun. 27, 2017

(54) SYSTEM AND METHOD FOR SAMPLING AND PROCESSING MASS AIR FLOW SENSOR DATA

(71) Applicant: GM GLOBAL TECHNOLOGY OPERATIONS LLC, Detroit, MI (US)

(72) Inventors: Yun Xiao, Ann Arbor, MI (US); Chad E. Marlett, Plymouth, MI (US); Joseph Zammit, Livonia, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 972 days.

(21) Appl. No.: 13/826,324

(22) Filed: Mar. 14, 2013

(65) Prior Publication Data

US 2014/0278012 A1 Sep. 18, 2014

(51) Int. Cl.
*F02D 41/18* (2006.01)
*F02D 41/00* (2006.01)
*F02D 41/28* (2006.01)

(52) U.S. Cl.
CPC ..... *F02D 41/0002* (2013.01); *F02D 41/18* (2013.01); *F02D 41/187* (2013.01); *F02D 2041/288* (2013.01)

(58) Field of Classification Search
CPC ..... F02D 2041/288; F02D 41/0002; F02D 41/18; F02D 41/187; F02D 2200/04; F02D 2200/0402; F02D 2200/0404; F02D 2200/0406; F02D 2200/0408
USPC ..... 701/33.6, 102, 103, 108, 114, 115; 73/114.31–114.37, 118.2
See application file for complete search history.

(56) References Cited

U.S. PATENT DOCUMENTS 5,646,344 A * 7/1997 Konzelmann ..... F02D 41/045 73/198
5,978,727 A * 11/1999 Jones ..... F02P 17/08 701/101
6,370,935 B1 * 4/2002 He ..... F02D 41/0055 702/100
2006/0224298 A1 * 10/2006 Lang ..... G01F 1/72 701/114
2009/0222231 A1 * 9/2009 Berger ..... F02D 41/187 702/104
2012/0089317 A1 * 4/2012 Herbolzheimer ..... B60H 1/005 701/102

* cited by examiner

*Primary Examiner* — Stephen K Cronin
*Assistant Examiner* — Jacob Amick
(74) *Attorney, Agent, or Firm* — Quinn IP Law

(57) ABSTRACT

A vehicle includes an engine having cylinders in fluid communication with an intake air flow, a mass air flow (MAF) sensor positioned with respect to the intake air flow which outputs a pulse train signal describing the frequency of the intake air flow, and a controller. The controller includes a calibrated non-linear conversion curve recorded in memory. The controller executes a method to convert the frequency data into a corresponding mass air flow using the calibrated non-linear conversion curve, determines the instantaneous mass air flow value at each leading or trailing edge of the pulse train signal, and accumulates the instantaneous mass air flow values over a calibrated duration. A time-weighted average of the accumulated mass air flow values is then used to execute a control action. The controller includes a host computer device and memory storing the curve and instructions for executing the method.

16 Claims, 2 Drawing Sheets

SYSTEM AND METHOD FOR SAMPLING AND PROCESSING MASS AIR FLOW SENSOR DATA

TECHNICAL FIELD

The present disclosure relates to the sampling and processing of sensor data from a mass air flow sensor.

BACKGROUND

In an internal combustion engine, ambient intake air passes through a particulate filter and into the intakes of the various engine cylinders, whereupon the clean air mixes with a calibrated amount of fuel. The fuel/air mix is then ignited via spark or compression. The force of the fuel combustion occurring within the cylinders generates engine torque, which is then transmitted to an input member of a transmission. A coupled output member of the transmission thereafter delivers output torque to the drive axles to propel the vehicle.

Because of the importance of air flow to the combustion process, engine control units and various onboard processes require knowledge of the amount of air flow entering the cylinders. For this reason, a mass air flow (MAF) sensor is typically positioned near the air intakes of the engine. A typical MAF sensor outputs a frequency or period signal to the engine control unit. Conventional approaches to determining the mass air flow from such frequency information include directly sampling the frequency signal using, e.g., crank angle-based or time-based sampling. Crank angle-based sampling involves converting frequency value at a specific crank angle to a corresponding MAF value. Time-based sampling occurs on the frequency signal at calibrated intervals as opposed to at specific crank angles.

SUMMARY

A system and method are disclosed herein that improve on the accuracy of the conventional sampling approaches noted above by foregoing sampling in the underlying frequency domain of a mass air flow (MAF) sensor in favor of sampling in a converted mass domain, which is determined in a non-linear manner from the underlying frequency domain data. The present system and method is intended to better account for the presence of pulsation in the clean air flow entering the engine, and can thus avoid possible signal aliasing and information gaps common to conventional frequency-domain sampling techniques. As a result, the present system and method may enable calculation of critical vehicle parameters with improved accuracy, e.g., calculation of cylinder air flow, air-fuel ratio, concentrations of O2 in the exhaust stream, exhaust gas regeneration (EGR) valve control, and the like.

In particular, a vehicle is disclosed herein that includes an internal combustion engine, a mass air flow (MAF) sensor, and a controller. The engine includes cylinders in fluid communication with an intake air flow. The MAF sensor, which is positioned with respect to the intake air flow, outputs frequency data via a pulse train signal describing the respective frequency of the intake air flow. The controller, which is in communication with the MAF sensor, includes a recorded calibrated non-linear conversion curve.

The controller in this embodiment translates the frequency data from the MAF sensor into an instantaneous mass air flow using the calibrated non-linear conversion curve, and then calculates a time-weighted average of the instantaneous mass air flow over a calibrated duration, e.g., a full cylinder event or a full drive cycle. The controller also executes a control action with respect to the vehicle using the time-weighted average.

The controller may include a computer device in communication with the MAF sensor that includes a processor and tangible, non-transitory memory, and instructions recorded in the memory, including a calibrated non-linear conversion curve.

The method may include receiving the MAF data via the controller, converting the frequency information of the received MAF data into an instantaneous mass flow via a calibrated non-linear conversion curve over a full cylinder event, and calculating the instantaneous air mass flow at every leading or trailing edge of the pulse train signal. The method may also include accumulating the calculated instantaneous mass air flow values over the full cylinder event, as well as calculating a time-weighted mass air flow as a function of the accumulated instantaneous mass air flow values. A control action may be executed as part of the method using the calculated time-weighted average.

The above features and advantages and other features and advantages of the present invention are readily apparent from the following detailed description of the best modes for carrying out the invention when taken in connection with the accompanying drawings.

DETAILED DESCRIPTION

Figure 1:
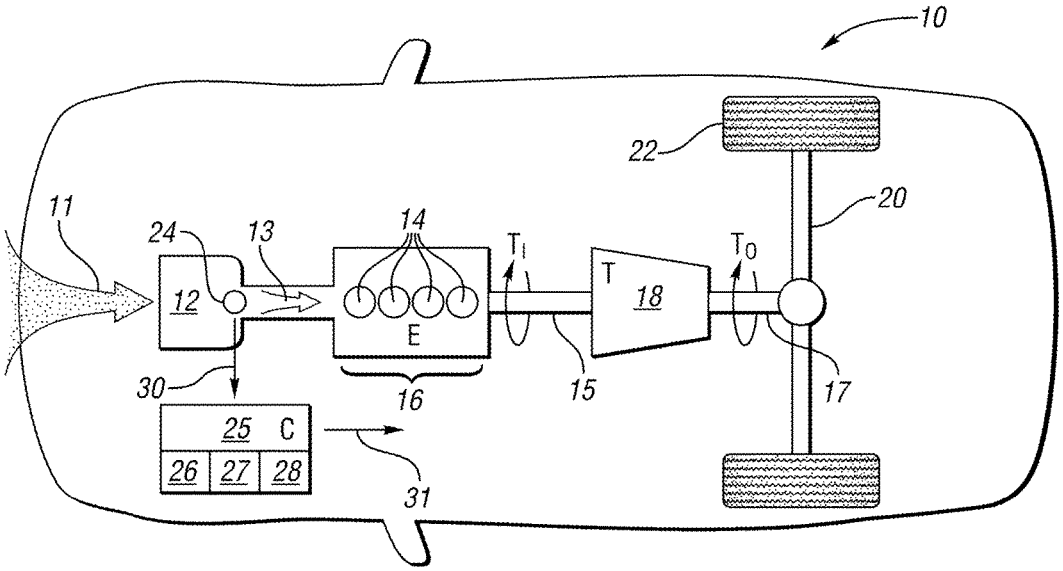
FIG. 1 is a schematic illustration of a vehicle having a mass air flow (MAF) sensor and a controller configured to sample and process MAF data as set forth herein.

Referring to the drawings, wherein like reference numbers refer to like components, and beginning with FIG. 1, a vehicle 10 includes an internal combustion engine (E) 16 having cylinders 14. The cylinders 14 are in fluid communication with an intake air flow (arrow 11). While four cylinders 14 are shown in FIG. 1, more or fewer cylinders 14 may be used without departing from the intended inventive scope. Torque generated by the combustion of air and fuel mixed within the cylinders 14 generates input torque (arrow $T_I$) to an input member 15 of a transmission (T) 18. Although not shown in FIG. 1 for illustrative simplicity, the transmission 18 may include various clutches, brakes, gear sets, and any other elements necessary to transmit output torque (arrow $T_O$) at a desired speed ratio to an output member 17. Ultimately, the output torque (arrow $T_O$) is transferred to a set of drive wheels 22 via a drive axle(s) 20 to thereby propel the vehicle 10.

Figure 3:
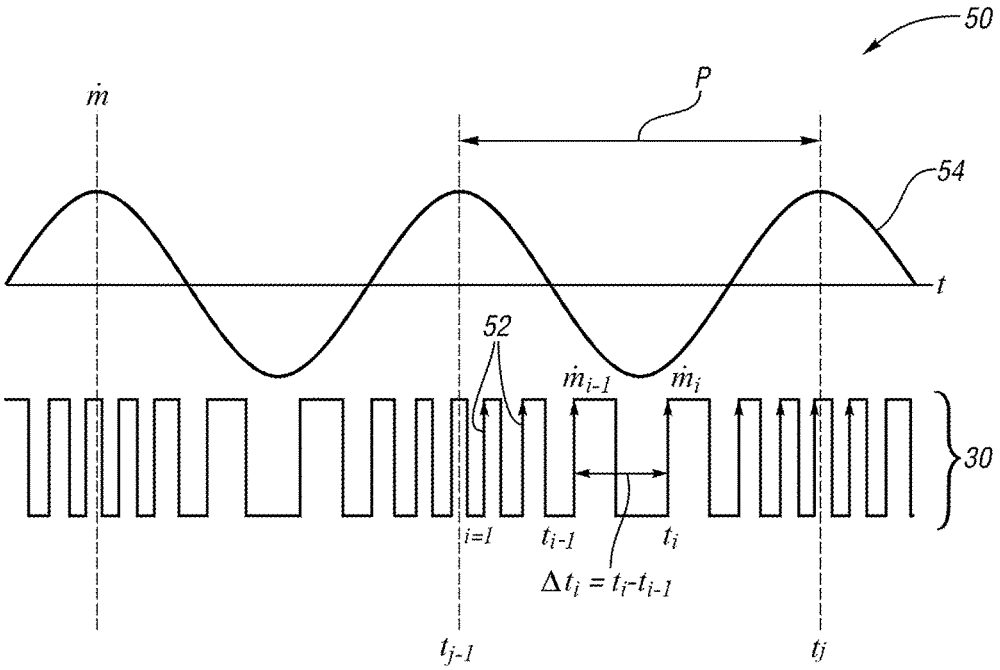
FIG. 3 is a time plot describing edge sampling of the corresponding mass air flow data according to the present approach.

The vehicle 10 includes a controller (C) 25, for instance an engine control unit, and a mass air flow (MAF) sensor 24. The MAF sensor 24 is in communication with the controller 25 over suitable transfer conductors and/or a wireless link. The MAF sensor 24 is positioned with respect to an engine air intake filter 12 within a clean flow of intake air flow (arrow 13), and is configured to output a MAF signal (arrow 30) as a pulse train signal as best shown in FIG. 3. The measured MAF signal (arrow 30) describes the frequency or period of the air flow (arrow 13) into the engine 16. That is, the frequency detected by the MAF sensor 24 increases as air is drawn into the cylinders 14 and decreases when the intake valve (not shown) for a given cylinder 14 closes.

Each frequency of the MAF frequency signal (arrow 30) corresponds to a different actual mass air flow value. Thus, the controller 25 of FIG. 1 uses the existing pulse train of the frequency signal (arrow 30) in the manner described below as part of the overall process of executing vehicle control actions such as calculating per cylinder air flow, air-fuel ratio, O2 concentrations, exhaust gas recirculation (EGR) control, and the like, and using these values in the control of a given vehicle system.

In a typical embodiment, the MAF sensor 24 of FIG. 1 may be a wire or wires whose temperature changes in accordance with the changing air flow (arrow 13) according to a known profile. That is, a given intake air flow (arrow 13) is required in order to maintain a given temperature of the MAF sensor 24, such that the mass air flow for a given discrete measured frequency value is an identifiable quantity. Other embodiments of the MAF sensor 24 may be used without departing from the intended inventive scope.

Figure 4:
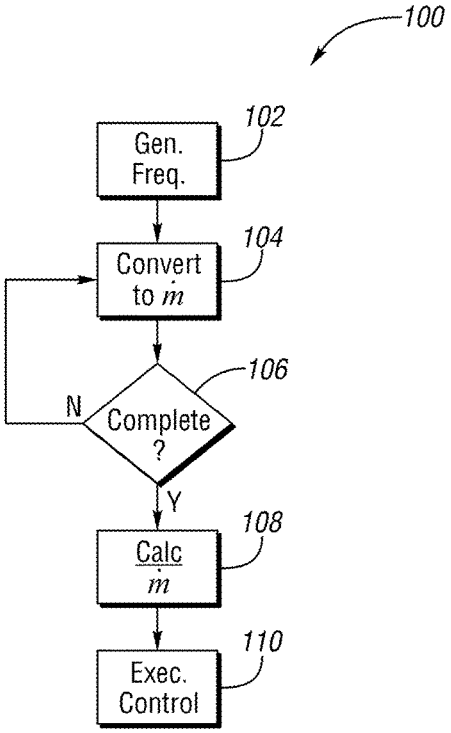
FIG. 4 is a flow chart describing an example method for sampling MAF data in the mass domain aboard the vehicle of FIG. 1.

The controller 25 shown in FIG. 1 may be embodied as one or more host computing devices, with associated hardware elements including a processor 26, tangible, non-transitory memory 27, and a transceiver 28. The memory 27 may include read only memory (ROM), flash memory, optical and/or additional magnetic memory, and the like. The controller 25 may also include sufficient transitory memory, e.g., random access memory (RAM) and electrically-programmable read only memory (EPROM), as well as any required input/output (I/O) circuit devices, high-speed clocks, analog-to-digital (A/D) and digital-to-analog (D/A) devices, and signal conditioning and buffer electronics. Instructions embodying the various steps of a method 100, an example of which is shown in FIG. 4, may be stored in memory 27 and executed by the processor 26 to provide the mass domain sampling and processing approach of the present invention, with any control steps commanded via the controller 25 via transmission of a set of output signals (arrow 31).

It is recognized herein that pulsations occurring in the flow of intake air (arrow 13), for instance due to piston reciprocation occurring within the cylinders 14 and/or valve actuation, may compromise the accuracy of data derived from the output of the MAF sensor 24. While this effect may be less pronounced in engines 16 having more cylinders relative to the example four cylinder engine 16 of FIG. 1, all engine designs may enjoy some level of performance improvement using the present approach relative to the accuracy gained via application of conventional frequency domain sampling techniques. Therefore, a key to the present approach is the sampling by the controller 25 of data from the MAF sensor 24 within the mass domain rather than in the normal frequency domain. This approach will now be described with reference to FIGS. 2-3.

Figure 2:
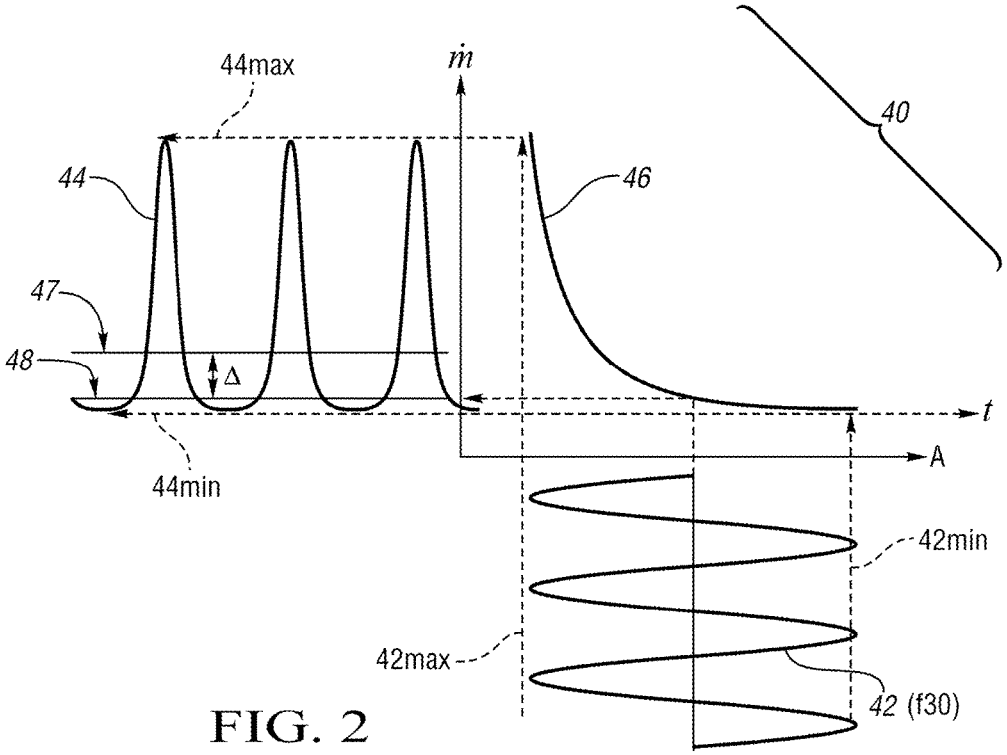
FIG. 2 is a time plot describing a conversion of frequency signals from the MAF sensor of FIG. 1 to corresponding mass air flow data using a non-linear conversion curve.

Referring to FIG. 2, a time plot 40, with time t plotted on the horizontal axis, describes an embodiment of conversion of a MAF signal (arrow 30) of FIG. 1 from the MAF sensor 24 into an instantaneous mass air flow ($\dot{m}$), which is plotted on the vertical axis. Because of the non-linearity of this conversion, averaging or filtering on the corresponding frequency data (trace 42), i.e., $f_{30}$, of amplitude (A) from the MAF sensor in the conventional manner may lead to error (Δ) in the results.

That is, the frequency data (trace 42) underlying the measurements taken by the MAF sensor 24 of FIG. 1 are not linearly related to the underlying mass air flow ($\dot{m}$). A calibrated non-linear curve 46 is thus provided herein to describe this relationship, with the corresponding mass air flow ($\dot{m}$) represented by trace 44 having a maximum ($\mathbf{44}_{MAX}$) and a minimum ($\mathbf{44}_{MIN}$). As a result, when averaging in the frequency domain, the result would be an artificially low average, which is represented as line 48 in FIG. 2. Averaging under the curve of trace 44, however, would reveal an actual average mass air flow at the level of line 47, and therefore a resultant error (Δ). The present approach therefore converts non-linearly to the mass air flow, i.e., generates trace 44 using the non-linear curve 46, as a preparatory step to the subsequent sampling and processing of such data. That is, the controller 25 of FIG. 1 projects the corresponding frequency data (trace 42) for the intake air flow (arrow 13) onto a calibrated non-linear conversion curve 46.

Referring to FIG. 3, trace 54 represents the instantaneous mass air flow ($\dot{m}$) per cylinder 14, and is plotted on the vertical axis with respect to time (t), which in turn is plotted on the horizontal axis. In particular, trace 54 is the mass air flow per cylinder 14 of FIG. 1 over the period (P) of one cylinder event, which as used herein means the duration between the opening of an intake valve of a cylinder at $t_{j-1}$ and the subsequent closing of the same intake valve at $t_j$ The period (P) of a cylinder event is defined as:

$$\frac{60}{RPM}\left(\frac{Str/Cyc}{2}\right)\left(\frac{1}{\text{No. } Cyl}\right)$$

where Str/Cyc represents the number of strokes per cylinder and No. Cyl represents the number of cylinders 14 in the engine 16 of FIG. 1. Thus, air flow to each cylinder 14 can be calculated.

The MAF signal 30 is also shown in FIG. 3 as an example pulse train. The corresponding mass air flow ($\dot{m}$) i.e., trace 54, is shown in an "ideal" form, that is, perfectly sinusoidal. Trace 54 could look quite different from this example embodiment, for example taking on the appearance of trace 44 of FIG. 2. Arrows 52 represent the sample timing edges, which in the embodiment shown is the leading edge of successive pulses from the MAF sensor 24 of FIG. 1, although the trailing/falling edges may be used in the alternative. The controller 25 uses such edge-triggered events in order to maximize the available information in the sampled mass air flow ($\dot{m}$), i.e., trace 54. For every edge trigger, the controller 25 converts the sampled time/period to an instantaneous mass air flow, e.g., using the MAF conversion curve 46 shown in FIG. 2, by calculation, lookup table, or other means.

Thereafter, the controller 25 of FIG. 1 calculates a time-weighted average ($\overline{\dot{m}}$) of the instantaneous mass air flows ($\dot{m}$) over the period (P). This is done for every cylinder event. The controller 25 may solve for the average mass air flow ($\overline{\dot{m}}$) using the following equation:

$$\overline{\dot{m}} = \left(\sum_{i=1}^{n} \Delta t_i \cdot \dot{m}_i\right) \Big/ \left(\sum_{i=1}^{n} \Delta t_i\right)$$

where the numerator describes the total mass air flow of fresh air entering each cylinder 14 and the denominator represents the accumulated time over one cylinder event, i.e., the period P, and thus provides associated rate information. Each value in this equation, i.e., the time-weighted average $\overline{\dot{m}}$ the numerator $$\left(\sum_{i=1}^{n} \Delta t_i \cdot \dot{m}_i\right),$$

and the denominator, may be used for different control purposes as needed.

Referring to FIG. 4, a method 100 for sampling and processing the MAF data (arrow 30) from the MAF sensor 24 of FIG. 1 begins with step 102, wherein the controller 25 receives the MAF data (arrow 30), e.g., via the transceiver 28. As this step occurs, the method 100 proceeds to step 104.

Step 104 entails converting the received corresponding frequency information from the MAF sensor 24 of FIG. 1 into an instantaneous mass flow, which is exemplified in FIG. 3 by trace 54. Step 104 may include projecting the frequency data (trace 42) onto the calibrated conversion curve 46 so as to generate the corresponding mass flow (trace 44) described above. The method 100 then proceeds to step 106.

At step 106, the controller 25 shown in FIG. 1 next determines if all frequency information has been received from the MAF sensor 24 of FIG. 1 for a full cylinder event, i.e., from the opening to the closing of a corresponding intake valve for each cylinder 14. If not, the method 100 repeats step 104. Otherwise, the method 100 proceeds to step 108.

Step 108 includes calculating the time-weighted average instantaneous mass air flow, i.e., $\overline{\dot{m}}$ as explained above with reference to FIG. 3. This value is recorded in memory 27 of the controller 25 of FIG. 1. For every edge trigger, denoted by the arrows 52 of FIG. 3, the controller 25 finds the underlying instantaneous air mass flow, and then calculates the time-weighted mass air flow ($\overline{\dot{m}}$).

The calculated data from step 108 may be allowed to accumulate, i.e., additively build, over an entire drive cycle, with the change in accumulated air mass over this time used to determine a cylinder-specific air mass rate. This value can be scaled into a cylinder-specific air mass for the cylinder event, which may be automatically reset or cleared by the controller 25 with each cylinder event to reduce accumulation of error. The method 100 then proceeds to step 110.

At step 110, the controller 25 of FIG. 1 may use the recorded values from step 108 in a subsequent control action of the vehicle 10, with the control action commanded via transmission of the output signals (arrow 31) to any required subsystem or other controller (not shown). For example, optimal control of certain types of engine function is predicated on the accurate understanding of the air flow to or air mass in each of the cylinders 14. Some examples include accurate air flow calculations for control of an EGR process, fuel/air mixture calculations for engine control, accurate calculations for engine exhaust purification techniques such as selective catalytic reduction and the like, etc. Thus, the output signals (arrow 31) shown in FIG. 1 may be a calculation of any of these values, and/or output of a diagnostic code to be recorded in memory 27.

As will be appreciated by those having ordinary skill in the art, use of the method 100 via the controller 25 of FIG. 1 may provide improvements in accuracy when determining the mass air flow into the engine 16. The present approach replaces time consuming calibration efforts, typically in the form of laborious encoding of correction maps to compensate for the number and size of pulsations in the air flow, with time-weighted averaging in the mass domain for a cylinder event. As the calculations are performed using air mass and not frequency data, this avoids conversion to and from air flow, all of which can reduce processing overhead and reduce overall error.

While the best modes for carrying out the invention have been described in detail, those familiar with the art to which this invention relates will recognize various alternative designs and embodiments for practicing the invention within the scope of the appended claims.

The invention claimed is:

1. A vehicle comprising:

an internal combustion engine having a plurality of cylinders each in fluid communication with an intake air flow;

a mass air flow (MAF) sensor positioned with respect to the intake air flow, wherein the MAF sensor is configured to output a pulse train signal describing a frequency or period of the intake air flow; and a controller in communication with the MAF sensor that includes a processor and tangible, non-transitory memory on which is recorded a calibrated non-linear conversion curve;

wherein the controller is configured to translate the frequency or period into a corresponding mass air flow using the calibrated non-linear conversion curve, determine the instantaneous mass air flow value at each leading or trailing edge of the pulse train signal, accumulate the instantaneous mass air flow values over a calibrated duration, calculate a time-weighted average of the accumulated mass air flow values, and execute a control action with respect to the vehicle using the time-weighted average.

2. The vehicle of claim 1, wherein the calibrated duration is a full cylinder event of the engine defined as one full air intake cycle for each cylinder of the engine.

3. The vehicle of claim 2, wherein the controller automatically resets the accumulated mass air flow values at the completion of the full cylinder event.

4. The vehicle of claim 1, wherein the controller calculates the time-weighted average as a function of the difference in time between leading or trailing edges of successive pulses of the pulse train.

5. The vehicle of claim 1, wherein the control action includes an adjustment of an air-fuel ratio in each of the cylinders.

6. The vehicle of claim 1, wherein the control action includes calculation of a concentration of oxygen in an exhaust stream of the vehicle.

7. The vehicle of claim 1, wherein the control action includes an exhaust gas recirculation control action.

8. A system for a vehicle having an internal combustion engine with a plurality of cylinders each in fluid communication with an intake air flow, and a mass air flow (MAF) sensor positioned with respect to the intake air flow, the system comprising:

a computer device in communication with the MAF sensor that includes a processor and tangible, non-transitory memory; and instructions recorded in the memory, including a calibrated non-linear conversion curve;

wherein the computer device is configured to execute the instructions from the memory to thereby receive a pulse train signal from the MAF sensor describing frequency data of the intake air flow, to translate the frequency data from the MAF sensor into a mass air flow via the calibrated non-linear conversion curve, to calculate the instantaneous mass air flow value at each leading or trailing edge of the pulse train signal, to accumulate the instantaneous mass air flow values over the calibrated duration, to calculate a time-weighted average of the accumulated mass air flow values, and to execute a control action with respect to the vehicle using the calculated time-weighted average.

9. The system of claim 8, wherein the calibrated duration is at least a full cylinder event of the engine defined as at least a full air intake cycle for each of the cylinders of the engine.

10. The system of claim 9, wherein the computer device automatically resets the accumulated instantaneous mass air flow values at the completion of each of the full cylinder events in the calibration duration.

11. The system of claim 8, wherein the computer device calculates the time-weighted average as a function of the difference in time between leading or trailing edges of successive pulses of the pulse train signal.

12. The system of claim 8, wherein the control action includes one of: an adjustment of an air-fuel ratio in each of the cylinders, calculation of a concentration of O2 in an exhaust stream of the vehicle, and an exhaust gas recirculation control action.

13. A method comprising:

receiving mass air flow (MAF) data from a MAF sensor positioned with respect to an intake air flow via a controller of a vehicle having an internal combustion engine with a plurality of cylinders each in fluid communication with an intake air flow, wherein the MAF sensor is configured to output a pulse train signal describing a frequency or period of the intake air flow;

translating the frequency or period of the pulse train signal of the received MAF data into an instantaneous mass flow, via the controller, using a calibrated non-linear conversion curve over a full cylinder event;

calculating the instantaneous air mass flow at every leading or trailing edge of the pulse train signal;

determining the instantaneous mass air flow value at each leading or trailing edge of the pulse train signal;

accumulating the calculated instantaneous mass air flow values over the full cylinder event;

calculating a time-weighted average of the accumulated mass air flow values; and executing a control action with respect to the vehicle using the calculated time-weighted average.

14. The method of claim 13, further comprising: resetting the accumulated mass air flow after completion of the full cylinder event.

15. The method of claim 13, further comprising:

calculating a cylinder-specific air mass rate for the full cylinder event; and converting the calculated cylinder-specific mass air rate into a cylinder-specific air mass for the full cylinder event.

16. The method of claim 13, wherein executing a control action with respect to the vehicle includes controlling an exhaust gas regeneration (EGR) process or a fuel/air mixture for the engine.

* * * * *